US012084931B2

(12) United States Patent
McGarian

(10) Patent No.: US 12,084,931 B2
(45) Date of Patent: Sep. 10, 2024

(54) SELECTIVELY ACTIVATABLE DOWNHOLE TOOL

(71) Applicant: Bruce McGarian, Aberdeen (GB)

(72) Inventor: Bruce McGarian, Aberdeen (GB)

(73) Assignee: ODFJELL TECHNOLOGY INVEST LTD, Aberdeen (GB)

( * ) Notice: Subject to any disclaimer, the term of this patent is extended or adjusted under 35 U.S.C. 154(b) by 0 days.

(21) Appl. No.: 18/027,893

(22) PCT Filed: Oct. 12, 2021

(86) PCT No.: PCT/GB2021/052630

§ 371 (c)(1),
(2) Date: Mar. 22, 2023

(87) PCT Pub. No.: WO2022/079423

PCT Pub. Date: Apr. 21, 2022

(65) Prior Publication Data

US 2023/0374875 A1 Nov. 23, 2023

(30) Foreign Application Priority Data

Oct. 14, 2020 (GB) ..... 2016273

(51) Int. Cl.
*E21B 23/04* (2006.01)
*E21B 23/00* (2006.01)
*E21B 33/134* (2006.01)

(52) U.S. Cl.
CPC ..... *E21B 23/042* (2020.05); *E21B 23/006* (2013.01); *E21B 23/0411* (2020.05);
(Continued)

(58) Field of Classification Search
CPC ..... E21B 23/04; E21B 23/042; E21B 23/006; E21B 23/0411; E21B 23/0412; E21B 23/0413
See application file for complete search history.

(56) References Cited

U.S. PATENT DOCUMENTS 6,095,249 A 8/2000 McGarian et al.
2009/0126936 A1* 5/2009 Begley ..... E21B 23/04 166/319

(Continued)

FOREIGN PATENT DOCUMENTS

GB 2447093 9/2008
WO WO01/88327 11/2001

OTHER PUBLICATIONS

International Search Report and Written Opinion for PCT/GB2021/052630, mailed Dec. 7, 2021.

*Primary Examiner* — Kristyn A Hall

(74) *Attorney, Agent, or Firm* — Klarquist Sparkman, LLP

(57) ABSTRACT

A tool comprises a tool body having a bore, a secondary chamber within the tool body, a flow port between the bore and the secondary chamber; a cover component within the bore moveable between at least two positions along the length of the bore, and a control arrangement connected to control movement of the cover component within the bore. The control arrangement comprises a moveable piston and a guide component, one of which has a track and the other has a protruding element received in the track. In a first position, the cover component covers an entrance to the flow port, so that fluid flowing along the bore may not flow into the flow port. In a second position, the cover component does not cover the entrance to the flow port, so that fluid flowing along the bore may flow through the flow port and into the secondary chamber.

20 Claims, 8 Drawing Sheets

(52) U.S. Cl.
CPC ..... *E21B 23/0412* (2020.05); *E21B 23/0413* (2020.05); *E21B 33/134* (2013.01)

(56) References Cited

U.S. PATENT DOCUMENTS

2010/0089583 A1* 4/2010 Xu ..... E21B 47/13
175/57
2010/0193196 A1* 8/2010 McGarian ..... E21B 21/103
166/373
2014/0284058 A1* 9/2014 Watson ..... E21B 43/26
166/308.1
2019/0024479 A1* 1/2019 Bocangel Calderon .....
E21B 23/0413

* cited by examiner

SELECTIVELY ACTIVATABLE DOWNHOLE TOOL

CROSS REFERENCE TO RELATED APPLICATIONS

This is the U.S. National Stage of International Application No. PCT/GB2021/052630, filed Oct. 12, 2021, which was published in English under PCT Article 21(2), which in turn claims the benefit of Great Britain Application No. 2016273.1, filed Oct. 14, 2020. The prior application is incorporated herein in its entirety.

DESCRIPTION OF INVENTION

This application relates to a downhole tool which may be incorporated into a drill string which is run into a well bore, and which may be selectively activated from the surface while the tool is in the well bore.

One example of a downhole tool of this kind is a tension swivel anchor which may be selectively activated.

A tension swivel anchor (TSA) is a tool which, when activated, grips against the interior of the casing of a well bore. The TSA forms part of a drill string, and is connected to further components above and below. When the TSA has been activated, the entire drill string may be rotated, without this rotation being transmitted to the parts of the TSA which engage the casing. The TSA may therefore be anchored longitudinally within the casing, and allow rotation of the drill string.

This is of use in, for example, a casing cutting operation, in which cutters are deployed outwardly from a tool body, and are used to cut through the casing through rotation of the drill string. The use of a TSA in the drill string close to the casing cutter allows the drill string to be anchored firmly, and centred, within the casing at the desired depth while the cutting operation takes place.

When the TSA has been activated, it is also common practice to pull upwardly on the drill string, so that the region of casing which is being cut is pulled into tension.

It is desirable to be able to activate a TSA in a reliable and straightforward manner from the surface, when the TSA is at the correct depth within the well bore.

It is also desirable to be able to activate and deactivate a TSA repeatedly, and on demand.

The invention also covers other selectively actuatable tools, such as isolation tools. Tools embodying the invention may find use in oil and gas drilling and exploration, but may also find application in other fields and industries, including the water and mining industries.

It is an object of the invention to provide a tool which is repeatedly selectively activatable from the surface when the tool has been run into a well bore as part of the drill string.

Accordingly, one aspect of the present invention provides a tool according to claim 1.

A further aspect of the invention provides a method according to claim 20.

Preferred aspects of the invention are as set out in the dependent claims.

In order that the invention may be more readily understood, embodiments thereof will now be described, by way of example, with reference to the accompanying drawings, in which:

FIG. 1 shows an overall view of a tool 1 embodying the present invention.

FIG. 2 shows an upper part 2 of the tool 1, which includes an indexing mechanism.

Figure 1:
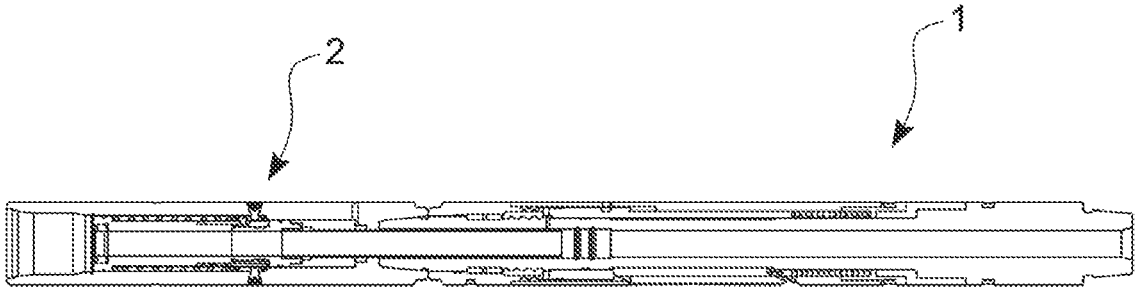
FIG. 1 shows a tool embodying the present invention.

The upper part 2 of the tool 1 includes an upper housing 3, which takes the form of a generally cylindrical body having a hollow interior. At an upper end 4 of the upper housing 3 a connection is provided, to allow the tool 1 to be connected to another component immediately above it in a drill string. In the example shown the connection takes the form of a standard threaded connection 5, which in accordance with standard practices is preferably a right-hand threaded connection. Any other type of connection may also be used, however.

Figure 3:
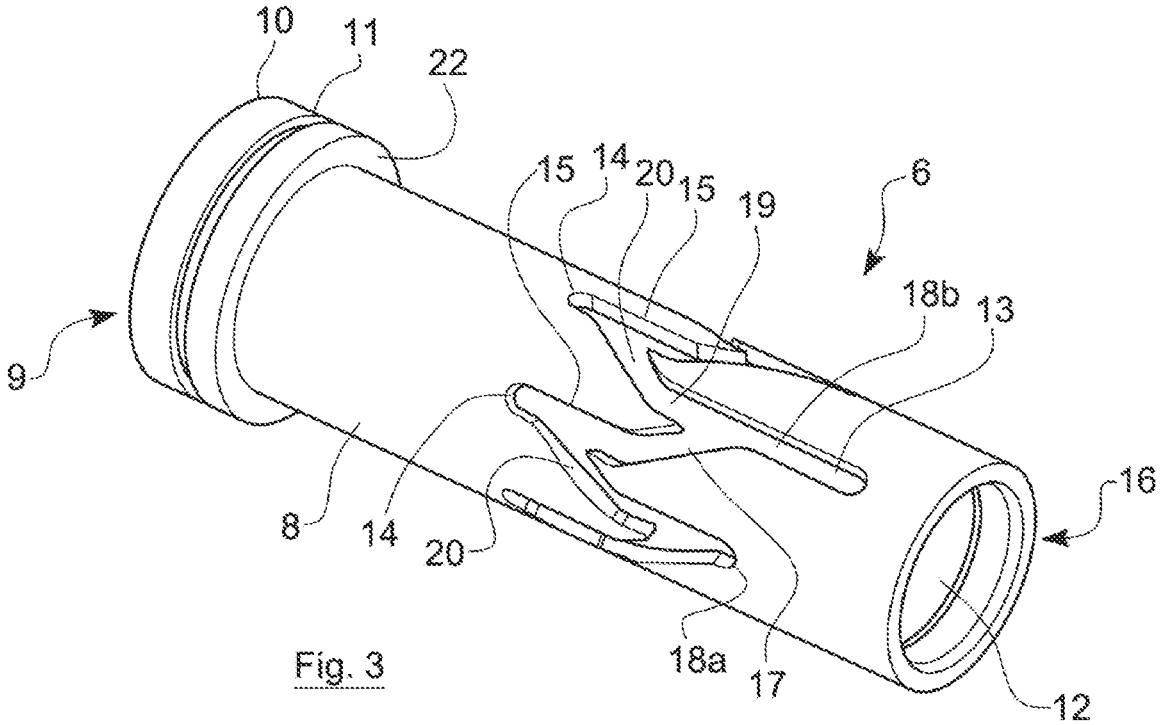
FIG. 3 shows a piston suitable for use with the invention.

A piston 6 is received within the bore 7 of the upper housing 3, and is shown in isolation in FIG. 3.

As can be seen in FIG. 3, the piston 6 takes the form of an elongate, hollow body defined by a generally cylindrical side wall 8. The cylindrical side wall has generally consistent internal and external diameters over the majority of its length. At its upper end 9, the piston 6 has an enlarged flange 10, having a diameter which is substantially the same as, or slightly less than, the internal diameter of the upper housing 3. The flange 10 has a circumferential groove 11 running therearound, which will, in use, contain a seal (not shown) which may take the form of an O-ring. The lower side of the flange 10 presents a downward-facing shoulder 22.

The piston 6 has a central bore 12 running along the length thereof.

On its outer side, the cylindrical side wall 8 of the piston 6 has a track 13 formed therein. In the embodiment shown in FIG. 3, the track 13 is formed by one or more grooves which are present in the outer side of the cylindrical housing 8. The grooves do not preferably pass all the way through the side wall 8 of the piston 6. In preferred embodiments, the internal diameter of the side wall 8 is constant or substantially constant along the length of the piston 6, and is not affected by the track 13.

In the example shown in FIG. 3, the track 13 has a repeating pattern. The track 13 has a series of peaks 14, which lie relatively close to the upper end 9 of the piston 6. From each peak 14, a first section 15 extends generally directly towards the lower end 16 of the piston 6, i.e. generally parallel with the longitudinal axis of the piston 6. At the lower end of each first section 15, a second section 17 extends diagonally across the exterior of the piston 6, and in preferred embodiments each section 17 may be angled at approximately 45° to the longitudinal axis of the piston 6.

At the lower end of each second section 17 (i.e. the end closest to the lower end 16 of the piston 6) the second section runs into a trough 18*a*, 18*b*, which extends generally directly downwardly, i.e. parallel substantially parallel with the longitudinal axis of the piston 6.

As can be seen in FIG. 3, each section of track may have either a relatively short trough, as indicated by 18*a* on the lower side of the piston 6 as seen in FIG. 3, or a longer trough, as indicated by 18*b* towards the upper side of the piston 6 as shown in FIG. 3. A longer trough 18*b* extends further towards the lower end 16 of the piston 6 than a shorter trough 18*a*.

In either case, the trough 18*a*, 18*b* forms the lower part of a third section 19, which extends generally parallel with the longitudinal axis of the piston 6, and extends upwardly beyond the point where it meets the second section 17.

At its upper end, each third section 19 meets a slanting fourth section 20, which extends at an angle with respect to longitudinal axis of the piston. Once again, the fourth section 20 may be angled at around 45° to the longitudinal axis of the piston 6.

Each fourth section 20 runs into the first section 15 of the next part of the track 13, near the peak 14 thereof.

The skilled reader will therefore understand that the track 13 forms a repeating pattern around the exterior of the piston 6. In preferred embodiments, the track 13 performs a repeating pattern that is continuous, i.e. extends all the way around the exterior of the piston 6. In other embodiments, however, the track may have one or more breaks in it.

Preferably each section of the track 13 is identical or substantially identical, aside from the fact that some sections have short troughs 18*a* and other sections have longer troughs 18*b*.

Figure 2:
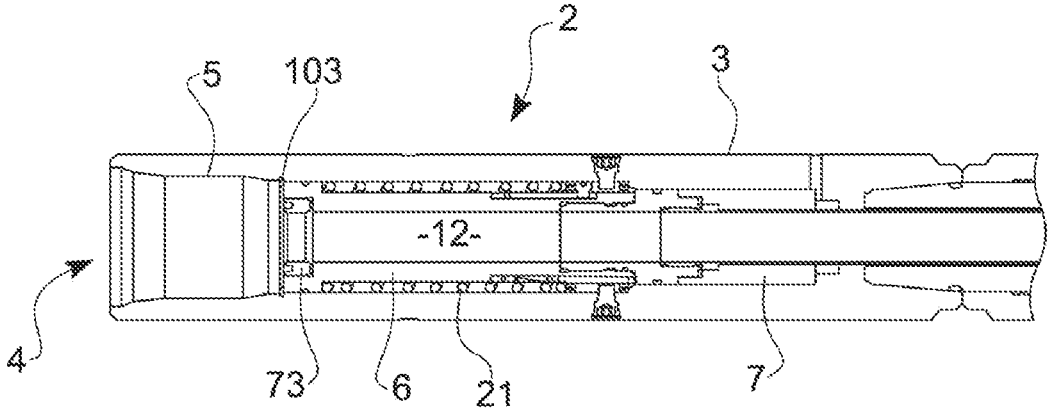
FIG. 2 shows an upper part of the tool of FIG. 1.

Returning to FIG. 2, the piston 6 is parallel within the bore 7 of the upper housing 3, and is not fixed with respect to the upper housing 3 in the longitudinal direction. The piston 6 may therefore slide upwardly or downwardly within the housing 3. Preferably, however, the piston 6 is constrained so that it may not rotate with respect to the upper housing 3. This may be achieved, for example, by one or more keys which slide in corresponding keyways (not shown), or by any other suitable means.

Figure 4:
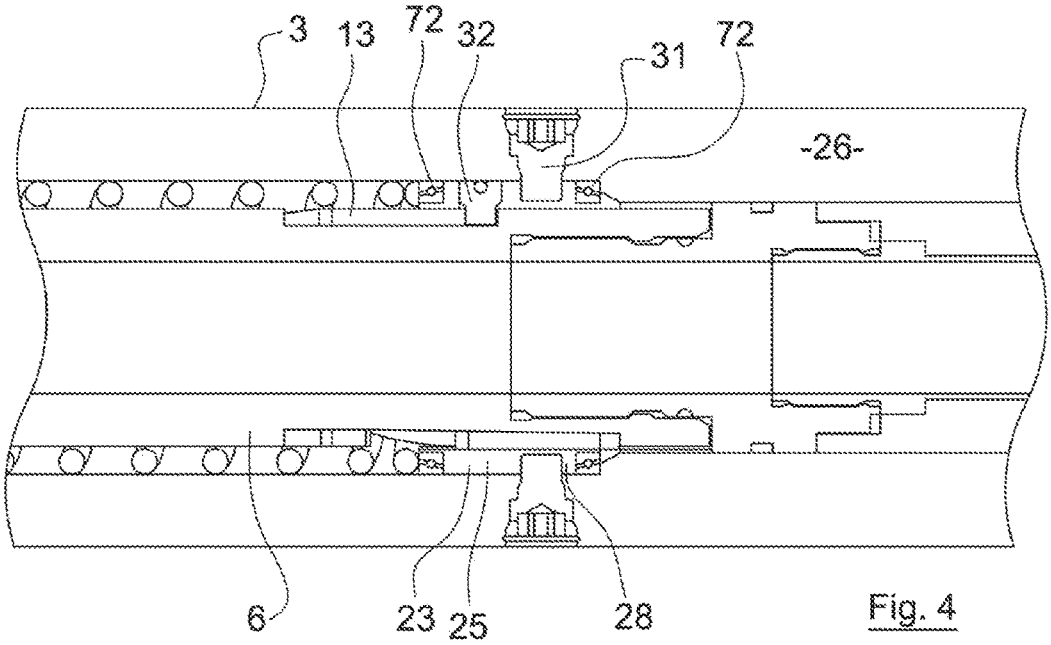
FIG. 4 shows a close-up section of part of the tool of FIG. 1.
Figure 5:
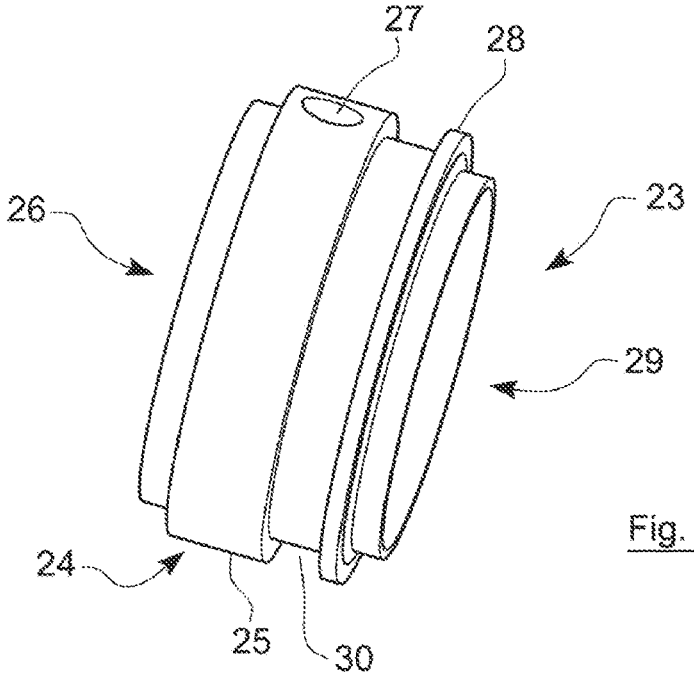
FIG. 5 shows a control ring suitable for use with the invention.

An enlarged view of the tool 1 in the region of the lower part of the piston 6 is shown in FIG. 4, for the purposes of clarity. A control ring 23 is positioned around the piston 6, so that the piston 6 passes through the interior of the control ring 23. The control ring 23 is shown in isolation in FIG. 5.

The control ring 23 is generally cylindrical in form, having a substantially constant internal diameter.

The outer surface 24 has a first raised rib 25 running around the circumference thereof. The first rib 25 is close to the upper end 16 of the control ring 23. An aperture 27 passes through the first rib 25, and all the way through the thickness of the wall of the control ring 23, communicating with the internal bore thereof.

A second raised rib 28 is provided closer to the lower end 29 of the control ring 23.

A groove 30 is formed between the first and second ribs 25, 28.

A pair of guide pins 31 protrude through the wall 26 of the upper housing 3, and extends inwardly into the internal bore 7 of the upper housing 3. The guide pins 31 are received in the trough 30 between the two ribs 25, 28 of the control ring 23, thus fixing the control ring 23 longitudinally in place within the upper housing 3. The control ring 23 may not move upwardly or downwardly within the upper housing 3, but it may rotate with respect thereto. While two guide pins 31 are shown in the figures, any suitable number may be used.

Figure 6:
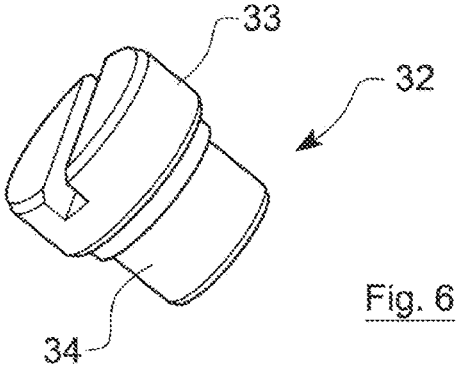
FIG. 6 shows a control pin suitable for use with the invention.

A control pin 32 is shown in FIG. 6. The control pin 32 includes head 33 and a narrower shaft 34.

The control pin 32 is received in the aperture 27 in the first rib 25 of the control ring 23. Preferably the head 33 of the control pin 32 and the aperture 27 have corresponding threads formed on their surfaces, so the control pin 32 can be screwed into the aperture 27, although any other suitable attachment method (such as an interference fit) may also be used. The control pin 43 is preferably locked in place once it is installed in the aperture 27. The head 33 of the control pin 32 lies below the outer surface of the first rib 25, and does not protrude outwardly beyond the first rib 25. The free end of the shaft 34 protrudes inwardly into the interior bore of the control ring 23.

In the example shown in the figures, only one control pin 32 is provided. However, there may be two control pins, provided on opposite sides of the control ring 23, both of which protrude into the track 13. Having two control pins in this way will result in improved load balancing and reliability. The skilled reader will appreciate that the track 13 must have matching short and long troughs 18*a*, 18*b* on opposite sides of the piston 6 for this to be possible.

The free end of the shaft 34 of the control pin 32 is received in the track 13 of the piston 6. The control pin 32 (also sometimes referred to as a guide component) therefore links the motions of the piston 6 and control ring 23. The control pin 32 is preferably constrained to move within the track 13.

Returning to FIG. 4, bearings 72 are provided above the first rib 25 and below the second rib 28, to allow smooth rotation of the control ring 23 with respect to the piston 6 and the upper housing 3. A spring 21 is positioned within the upper housing 3, around the exterior of the piston 6, and is held in place between the downward-facing shoulder 22 formed by the flange 10 of the piston 6, and the bearing 72 positioned above the first rib 25 of the control ring 23. The effect of the spring 21 is to bias the piston 6 upwardly with respect to the upper housing 3, and the piston 6 is shown in this position in FIG. 2. In this position the control pin 32 will lie at the lower end of one of the troughs 18 of the track 13, and this will limit the upward motion of the piston 6 within the upper housing 3.

The longitudinal movement of the piston 6 can be controlled in an indexed fashion, as will be described below.

In order to operate the indexing system, the piston 6 is driven downwardly with respect to the upper housing 3. This can be achieved either by dropping a ball to be received in a seat 73 in the piston 6, or by increasing fluid flow/circulation within the drill string so that the pressure drop across the piston forces the piston 6 downwardly with respect to the upper housing 3. The example below will be discussed with respect to the dropping of a ball.

As a first step, a ball (not shown) is dropped through the drill string, and received in the seat 73 in the piston 6. In the example shown the seat 73 is formed at the top end of the piston 6, but this need not be the case. Fluid will not be able to flow or circulate through the piston 6, and fluid pressure will accumulate behind the ball. This will drive the piston downwardly with respect to the upper housing 3.

As this occurs, the control pin 32 will move along the third section 19 of the track, and as the downward motion continues the control pin 32 will then move along the slanting fourth section 20 of the track.

As the control pin 32 moves along the slanting fourth section 20 of the track 13, the control ring 23 will rotate within the upper housing 3.

This will continue until the control pin 32 is received in the corresponding peak 14, at which point the downward motion of the piston 6 will be halted.

The next step depends on how many cycles of the indexing system the operators wish to perform. If only one cycle is needed, then the ball may be removed from the piston 6, by increasing the fluid pressure until the ball is extruded downwardly through the seat 73 in the piston 6, and is carried by the fluid out of the bottom of the piston 6. The ball may be caught by a ball catcher, as the skilled reader will understand, or may alternatively be carried out of the bottom of the tool 1 (where it may land in a seat to operate another component, be caught in a ball catcher elsewhere in the drill string, or be circulated up hole).

The piston 6 will then be pushed upwardly within the upper housing 3 once more by the spring 21. The control pin 32 will move downwardly along the first section 15 of the track 13, and then along the slanting second section 17 of the track 13, causing the control ring 23 to rotate once again with respect to the upper housing 3.

The control pin 32 will then move to the bottom of the corresponding trough 18*a*, 18*b*, thus arresting the upward motion of the piston 6.

The indexing system will have moved through one step by this process. In other words, the control ring 23 will have moved with respect to the track 13 along one of the repeated sections of track 13.

If the operators wish to move the indexing system through more than one cycle, then at the point where the control pin 32 is received in a peak 14, fluid flow/circulation through the tool 1 may be reduced, until the piston 6 is pushed upwardly within the upper housing by the spring 21, with the ball still held in the seat 73. As discussed above, the control pin 32 will then move downwardly along the first section 15 of the track, and along the slanting second section 17 of the track 13, causing the control ring 23 to rotate with respect to the upper housing 3. The control pin 32 will then move to the bottom of the corresponding trough 18*a*, 18*b*, thus arresting the upward motion of the piston 6.

Fluid flow/circulation can then be increased again, to drive the piston 6 downwardly and start another cycle of the indexing system. In this way, with the ball in the seat 73 of the piston 6, the indexing system can be cycled repeatedly by varying fluid pressure from surface. When the desired number of cycles has been performed, the ball can be extruded through the seat 73, as described above, to leave the indexing system in the appropriate position.

In yet a further possibility, a separate ball may be dropped into the tool 1, and then extruded from the seat 73, for every cycle of the indexing system, even if consecutive cycles are to be performed.

As mentioned above, some sections of the track 13 have relatively long troughs 18*b*, and other sections have relatively short troughs 18*a*. Which type of trough the control pin 23 is received in at the end of an index cycle will determine the longitudinal position within the upper housing 3 at which the piston 6 comes to rest.

The piston 6 shown in FIG. 3 has six repeated sections of track, five of which have short troughs 18*a*, and one of which has a long trough 18*b*.

In other embodiments, alternative sections of track may have long and short troughs.

In yet further embodiments, there may be two long troughs, preferably on opposing sides of the piston 6, with two sections having short troughs in between each of the long troughs (this arrangement would work with two control pins 23, as discussed above).

The skilled reader will appreciate that any arrangement of short and long troughs may be provided, to produce the desired technical result, which will be discussed in more detail below.

The skilled reader will also appreciate that it is not necessary to have exactly six cycles of track, and any desired number of sections may be included.

While the shape of each section of track is preferably the same as that of every other section of track (aside from the provision of relatively short and long trough), this also need not be the case.

Figure 7:
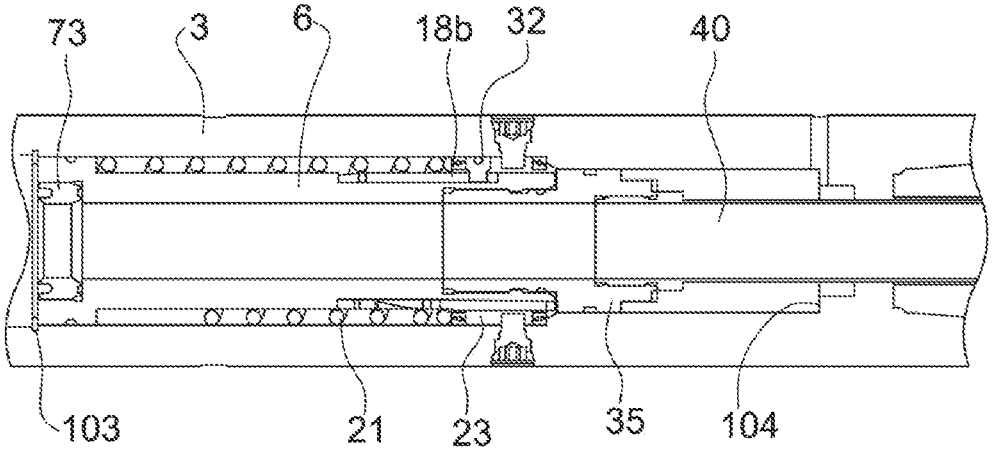
FIGS. 7 and 8 shows a section of the tool of FIG. 1, in two different stages of operation.
Figure 8:
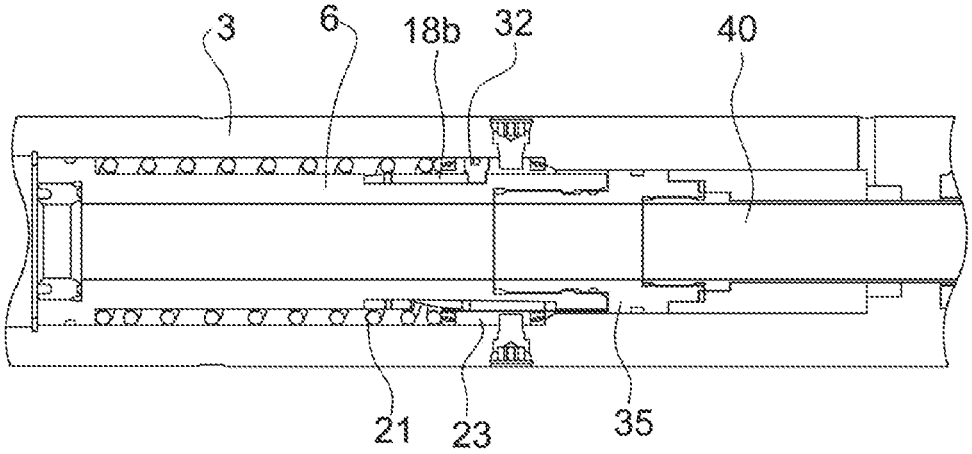

FIGS. 7 and 8 show the piston 6 in its resting state (i.e. when no significant downward forces are imposed on the piston 6 from the surface, for instance through dropping of a ball or increased fluid pressure), when the control pin 32 is at the end of a long trough 18*b* (as shown in FIG. 7) and at the end of a short trough 18*a* (as shown in FIG. 8). In each case the piston 6 is pushed upwardly as far as the limit of the trough 18*a*, 18*b* will allow, by the spring 21. As can be seen from these figures, when the control pin 32 is received in a relatively long trough 18*b*, the piston 6 is positioned further upwardly (towards the upper end 4 of the upper body 3) than when the control pin 32 is received in a relatively short trough 18*a*.

In preferred embodiments of the invention, the control pin 32 is protected to at least some extent from experiencing repeated large shearing forces. With reference to FIG. 7, a circlip 103 is provided in a groove on the inner surface of the upper housing 3, protruding inwardly from the surface. When the piston 6 moves upwardly in the upper housing 3, and the control pin 32 is in a longer trough 18*b*, the upper end 9 of the piston 6 will come into contact with the circlip 103 before the control pin 32 reaches the end of the trough 18*b*, and this prevents the control pin 32 from experiencing shearing forces as it strikes the end of the trough 18*b*. It can be seen in FIG. 7 that the control pin 32 is spaced apart from the end of the trough 18*b*.

Similarly, when the piston 6 is driven downwardly with respect to the upper housing 3, the lower end of the adaptor 35 will contact an upward-facing shoulder 104 formed in the bore 7 before the control pin 32 reaches the end of the peak 14 of the section of track 13.

Figure 9:
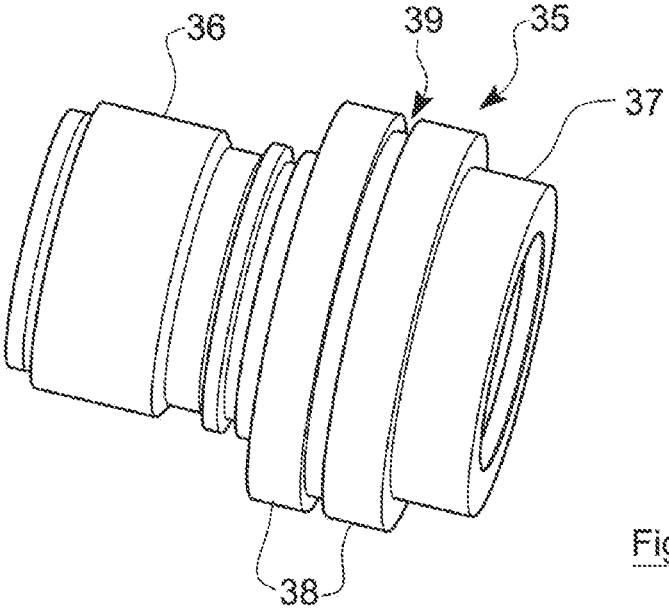
FIG. 9 shows an adaptor suitable for use with the invention.

An adaptor 35 is connected to the lower end of the piston 6. The adaptor 35 is shown in isolation of FIG. 9. The adaptor 35 includes a stem 36 at its upper end, which fits into the lower end of the piston 6, and at its opposite end has an outlet 37. Between the stem 36 and the outlet 37 two raised ribs 38 are formed on the outer surface of the adaptor 35, with a groove 39 being present between the raised ribs 38. In use an O-ring or similar seal will be provided in the groove 39. In practical embodiments a seal is positioned only in this groove 39 or in the groove 11 formed in the enlarged flange 10 at the upper end 9 of the piston 6. If seals are provided in both of these grooves 11, 39 then a vent, either inwardly into the main flow bore 7 or outwardly into the annulus, will need to be provided to allow smooth operation of the piston 6.

As can be seen from FIGS. 7 and 8, for example, the outer edges of the raised ribs 38 of the adaptor 35 lie against or close to the inner bore of the upper housing 3, and the O-ring will help to form a seal between the adaptor 35 and the inner surface of the outer housing 3.

A delivery pipe 40 is attached to the outlet 37 of the adaptor 35. The piston 6, adaptor 35 and delivery pipe 40 preferably define a substantially continuous, unbroken inner bore of constant or substantially constant diameter or cross-sectional area.

Figure 10:
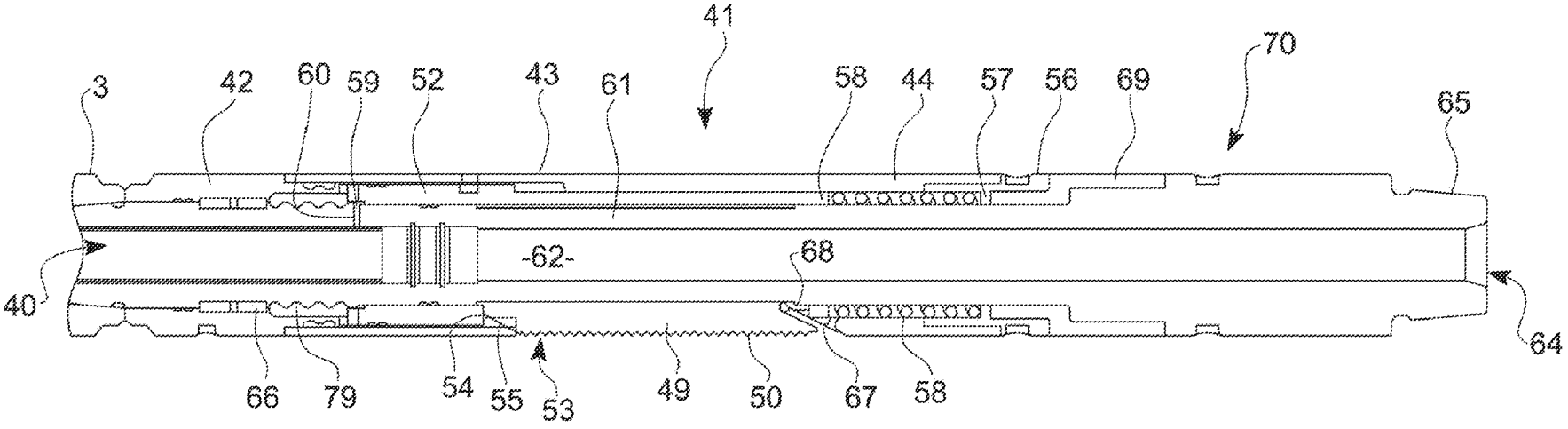
FIG. 10 shows a lower part of the tool of FIG. 1.

FIG. 10 shows the lower part of the tool 1. The lower end of the upper housing 3 can be seen at the left-hand side of FIG. 10.

The lower part of the tool 1 effectively comprises a TSA, the operation of which is controlled by the components of the upper part of the tool 1. The lower part of the tool 1 has a central mandrel 61, which at its upper end is attached to the lower end of the upper housing 3, and is rotationally fixed with respect thereto. The mandrel 61 extends along the length of the lower part of the tool 1, defining the main flow bore 62 thereof. In the example shown in the figures, the mandrel 61 has a narrowed section as it passes along the length of the lower part of the tool 1, and widens at the lower end 64 thereof to form the full width of the tool 1. At the lower end 64 a connection 65 is formed, to connect the tool 1 to a component immediately below it in a drill string. The connection 65 is preferably a standard threaded connection, but may take any suitable form.

A torque collar 42 immediately adjoins the lower end of the upper housing 3, and surrounds part of the mandrel 61. Keys 66 are positioned between the inner side of the torque collar 42 and the outer side of the mandrel 61, and received in suitable keyways in the torque collar 42 and mandrel 61, to prevent relative rotation between these components. A split load collar 79 is also positioned between the inner side of the torque collar 42 and the outer side of the mandrel 61, and in the embodiments shown is positioned below the keys 66 and keyways.

Figure 11:
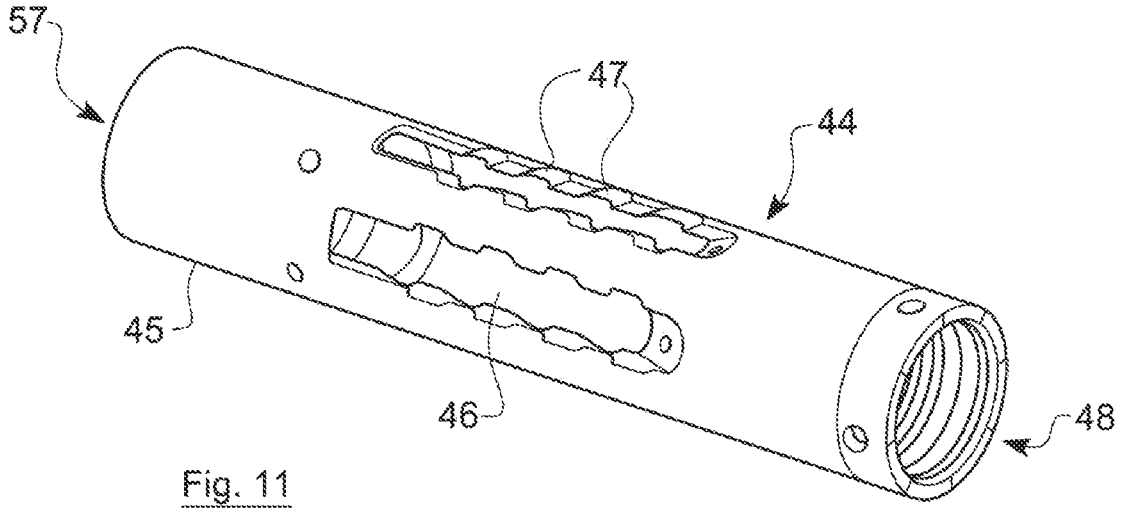
FIG. 11 shows a slip housing suitable for use with the invention.

A slip housing 44 is positioned below the torque collar 42. The slip housing 44 is shown in isolation in FIG. 11.

The slip housing 44 takes the form of a generally tubular, hollow body 45. The body 45 has a number of slip windows 46 formed therethrough. Each slip window 46 comprises an aperture formed through the entire thickness of the body 45. Preferably, the slip windows 46 are provided at the same or approximately the same longitudinal position along the body 45, and are angularly spaced apart from another around the circumference of the body 45.

Each slip window 46 is approximately rectangular, being elongated in a direction generally parallel with the longitudinal axis of the body 45. Each slip window 46 also comprises a number of slanting ribs 47 formed in each side wall thereof. As the ribs 47 pass from the inner side of the body 45 to the outer side thereof, they slant downwardly toward the bottom end 48 of the body 45.

Returning to FIG. 10, a slip 49 is provided in each slip aperture 46. Each slip 49 has an outer grip surface 50, which faces outwardly and is formed with teeth, ridges or any other suitable surface configuration/texturing which will allow it to grip effectively into the wall of a well bore casing. The skilled person will be well aware of how the grip surface of a slip may be formed for this purpose.

Each slip 49 has side walls having slanting grooves (not shown), which engage with the slanting ribs 47 formed in the slip windows 46.

Each slip 49 may move between a retracted position, in which the grip surface 50 does not substantially protrude beyond the level of the outer surface of the body 45, and a deployed position, in which the grip surface 50 of the slip 49 protrudes outwardly beyond the outer surface of the body 45. As the skilled reader will understand, due to the slanting ribs 47 and cooperating grooves, in the retracted position each slip 49 is positioned further towards the top end 51 of the slip housing 44, and in the deployed position each slip 49 is further towards the lower end 48 thereof.

A slip piston 52 is provided within the slip housing 44, positioned around the mandrel 61 and rotatable with respect thereto. The slip piston 52 has a number of apertures 53 formed therein, and one slip 49 is received within each aperture 53.

Referring to FIG. 10, at the upper side of the slip piston 52, no aperture is present and the slip piston 52 is substantially unbroken in the region of the slips 49.

At the bottom side of FIG. 10, a slip aperture 53 is formed, with the slip 49 being received in this aperture 53. In the examples shown each slip aperture 53 also includes a T-shaped slot at its top edge 54. Each slip 49 also has a T-shaped protrusion at its top end, which is received in the T-shaped slot of the corresponding slip aperture 53.

A bracing collar 56 is positioned immediately adjacent the bottom end 48 of the slip housing 44. The bracing collar 54 has an inward-facing lip 57.

A journal bearing 69 is provided below the bracing collar 56, between the bracing collar 56 and the widened lower portion 70 of the mandrel 61. The journal bearing 69 allows the bracing collar 56 and mandrel 61 to rotate relative to one another.

The skilled reader will therefore understand that the mandrel 61 forms a core of the lower part of the tool 1, which includes the connection 65 at the lower end 64 of the tool 1, which does not rotate with respect to the upper part 2 of the tool 1 (and importantly does not rotate with respect to the connection 5 formed at the upper end 4 of the tool 1). However, the slip housing 44, along with the slip piston 52 and slips 49, may rotate with respect to the mandrel 61.

A spring 58 is positioned within the slip housing 45. The spring 58 rests on the upper side of the rib 57 of the bracing collar 56 at its lower end, and rests against the lower end 58 of the slip piston 52 at its upper end. The effect of this spring 58 is to bias the slip piston 52 upwardly, and this position is shown in FIG. 10. When the slip piston 52 is biased fully upwardly, it contacts a lower end of the torque collar 42.

A drive chamber 59 is formed between the lower end of the torque collar 42, and the upper end of the slip piston 52. At its upper end 80, the slip piston 52 is narrowed, and has one or more apertures 81 passing therethrough. The drive chamber 59 surrounds the upper end 80 of the slip piston 52 (this can be seen more clearly in FIGS. 12 and 13, discussed below).

A fluid port 60 (also sometimes referred to as a flow port) is formed in the wall of the mandrel 61, and communicates between the main flow bore 62 of the lower housing 41, and the drive chamber 59 (also sometimes referred to as a secondary chamber).

As described above, a delivery pipe 40, which is connected to the indexing mechanism of the upper housing 3, protrudes into the upper part of the central bore 62 of the lower housing 41. In the example shown the delivery pipe 40 (also sometimes referred to as a cover component) has an O-ring 43 or other seal provided on its outer surface, near the open end thereof, to seal against the inner surface of the bore 62 and prevent or substantially prevent fluid flowing therepast. The delivery pipe 40 preferably does not entirely fill the central bore 62, and there is room around the delivery pipe 40 for fluid to flow between the outer surface of the delivery pipe 40 and outer wall of the interior bore 62.

The distance by which the delivery pipe 40 protrudes into the lower part of the tool is determined by the indexing system.

Figure 12:
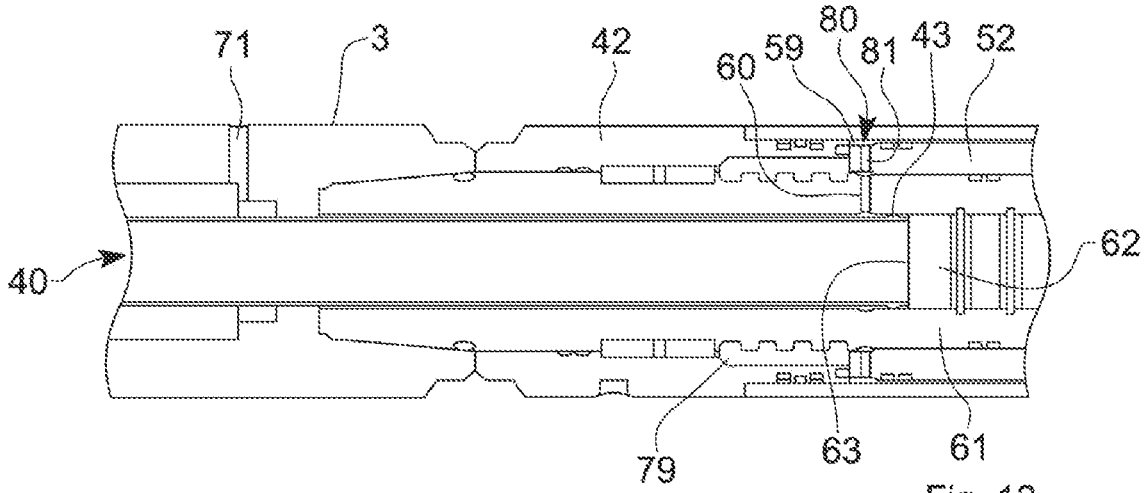
FIGS. 12 and 13 show sections of a further part of the tool of FIG. 1, in two different stages of operation.

Referring to FIG. 12, this figure shows a more close-view of the components of the tool 1 in the region at the end of the delivery pipe 40.

In FIG. 12 (as in FIG. 10), the delivery pipe extends a relatively long way into the central bore 62, and the end 63 of the delivery pipe 40 lies below the entrance to the fluid port 60.

Referring to the discussion above, the skilled reader will understand that, in this position, the control pin 32 lies in a relatively short trough 18*a*.

In this configuration, fluid flowing into the top end 4 of the tool will flow through the delivery pipe 40, and directly into the main bore 62 of the lower part of the tool 1, and out of the lower end 64 of the tool 1. The fluid does not flow into the fluid port 60, and is prevented from reaching the fluid port 60 by the seal 43 on the end 63 of the delivery pipe 40.

Figure 13:
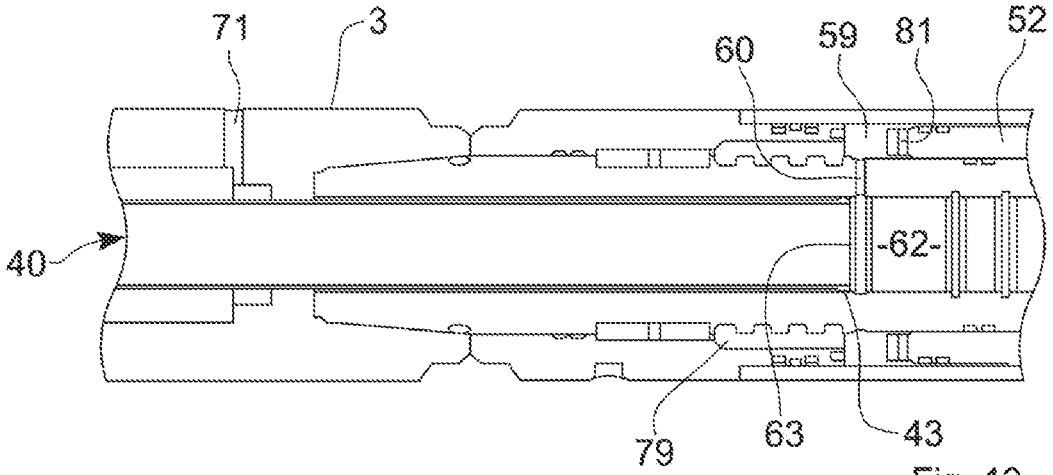

If the indexing system is operated so that the control pin 32 comes to rest at the end of a relatively long trough 18*b*, the piston 6 (and hence the delivery pipe 40) will come to rest closer toward the upper end 4 of the tool 1. This position is shown in FIG. 13.

In this configuration, the end 3 of the delivery pipe 40 lies above the fluid port 60. Fluid passing into the top end of the tool 1 will therefore flow down the delivery pipe 40, and will be able to pass through the fluid port 60 into the drive chamber 59 (the apertures 81 formed in the upper end 80 of the slip piston 52 allows fluid to flow reliably into the drive chamber 59). Pressurised fluid in this chamber 59 will act on the upper end of the slip piston 52, thus driving the slip piston 52 downwardly, as can be seen in FIG. 13. The effect of this is to drive the slips 49 downwardly from their retracted position into their deployed position. When this occurs, the slips 49 will move into contact with the inner surface of the casing of the well bore.

Tension is then preferably applied to the drill string, by pulling it upwardly, to cause the slips 49 to grip the inner surface of the casing. In this configuration, the tool 1 may act as a TSA, with rotation of the drill string being possible, and rotation of the drill string components above the TSA being transmitted to the drill string components below the TSA. For example, a casing cutting operation may take place, with a casing cutter below the TSA being activated so that its cutters protrude outwardly, and cut through the casing. As discussed above, the drill string is pulled upwardly, with the result that the casing is placed in tension in the region where it is cut.

To retract the slips 49, the flow of fluid into the tool 1 is stopped or reduced. The pressure of fluid in the drive chamber 59 will therefore drop, and the spring 58 will return the slip piston 52 to its initial position. As this occurs, fluid will be driven from the drive chamber 59 back through the fluid port 60, and will flow back into the main flow bore 62.

The skilled reader will appreciate that, with the indexing system in the appropriate position, the slips 49 of the tool 1 may be moved repeatedly between the deployed and retracted positions, by controlling the flow of fluid into the tool 1. There is no limit to the number of times the slips can be activated and subsequently deactivated again. The tool 1 therefore acts as an effective "on demand" TSA which can be easily integrated into a drill string.

To deactivate the slips, the indexing system is operated once more, so that the control pin 32 comes to rest at the end of a relatively short trough 18*a*. The delivery pipe 40 will then return to the position shown in FIG. 12, and pressurised fluid introduced into the tool 1 will no longer be provided to the drive chamber 59. When this is done, fluid in the drive chamber 59 will flow upwardly around the outer surface of the delivery pipe 40, where it may vent to the annulus through a vent port 71, which is formed near the lower end of the upper housing 3. This fluid will be prevented from passing into the main flow bore 62 by the seal 43 positioned near the end of the delivery pipe 40.

Figure 14:
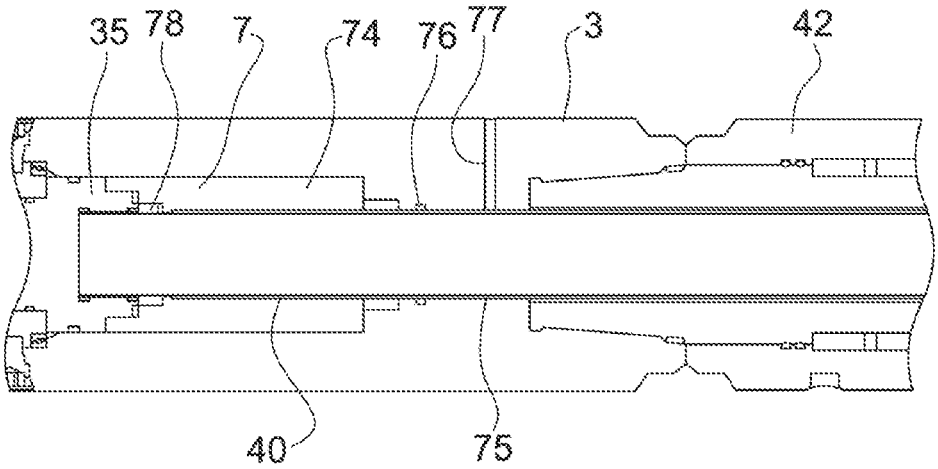
FIG. 14 shows components of a further tool embodying the present invention.

FIG. 14 shows component of a further embodiment of a tool 1 according to the invention. FIG. 14 is a close up view of the region around the adaptor 35, the delivery pipe 40 and the region where the upper housing 3 meets the torque collar 42.

Many of the components of the further embodiment are the same as those described above, and the discussion below will focus on the different features.

As discussed above, the piston 6 is received within a bore 7 of the upper housing 3. As can be seen in FIG. 14, there is a region of the bore 7 which is below the piston 6 (and adaptor 35), referred to here as the under-piston region 74 of the bore 7.

Below the bore 7 a channel 75 extends to the lower end of the upper housing 3, and the delivery pipe 40 is received within this channel 75. As discussed above, there is preferably a clearance between the inner surface of the channel 75 and the outer surface of the delivery pipe 40, so that fluid may flow around the exterior of the delivery pipe 40.

In this embodiment, an O-ring or similar seal 76 is received within a groove formed on the inner surface of the upper housing 3, below the level of the under-piston region 74. This seal 76 seals against the outer surface of the delivery pipe 40, so that fluid may not flow past the seal 76 along the channel 75 around the outside of the delivery pipe 40.

A vent port 77 extends between the channel 75 and the outer surface of the tool, to allow fluid flow between the channel 75 and the outside of the tool. The vent port 77 is provided between the seal 76 and the bottom of the upper housing 3. It should be noted that this is in a different location to the vent port 71 of the previous embodiment.

At the top end of the delivery pipe 40, near the region where the delivery pipe 40 connects to the adaptor 35, a communication port 78 is formed through the wall of the delivery pipe 40. The communication port 78 allows fluid to flow between the interior of the delivery pipe 40 and the under-piston region 74 of the bore 7.

The skilled reader will understand that, where no ball is received in the seat 73, when fluid is introduced into the tool 1 at a particular pressure, this pressure will be communicated to the under-piston region of the bore 7. This means that the piston 6 will effectively be pressure-balanced. Whatever the pressure of the fluid introduced into the tool, the same pressure will act against the upper surface of the piston 6, and also act against the lower end of the piston 6 (through the adaptor 35), as a result of the communication port 78 between the delivery pipe 40 and the under-piston region 74 of the bore 7.

In preferred embodiments, the upward-facing surface area of the upper part of the piston 6 is equal or substantially equal to the surface area against which fluid in the under-piston region 74 may act to drive the piston 6 upwardly. This surface area may comprise part of the piston 6, and/or it may comprise part of another component to which the piston 6 is connected, such as the adaptor 35.

In this embodiment, until a ball is received in the seat 73, the indexing system cannot be activated through fluid pressure alone. This confers certain advantages, as any rate of fluid flow/circulation through the tool can be applied without accidentally activating the indexing system. This is likely to be useful where the tool is provided as part of a drill string in which other components are also present, which will need to be controlled/activated before or after use of the tool, through the use of fluid flow.

It should be noted that the seal 76 prevents fluid in the under-piston region 74 from flowing along the channel 75 around the exterior of the delivery pipe 40. The communication port 78 is thus preferably the only way for fluid to enter or leave the under-piston region 74.

This is in contrast to the first embodiment discussed above, in which the piston 6 is not balanced in this way, and in which activation of the index system may be achieved either through dropping a ball or through control of fluid flow.

As can be understood from the foregoing description and the figures, the tool 1 has a relatively wide, unobstructed central bore which passes all the way through the tool 1, from the connection 5 at its upper end to the connection 65 at its lower end. This means that the tool 1 can be used in applications where cement is pumped through a drill string to perform a cementing operation. For instance, the tool 1 may form part of a drill string which is used in a plug and abandonment method. Such a drill string may include a bridge plug at its lower end, and also incorporate a casing cutter.

In use of the drill string, the drill string may be run into a well bore to a desired depth, and the bridge plug may then be activated and set in the well bore. The remaining components of the tool are then disengaged from the bridge plug, and the tool is pulled upwardly in the well bore. Cement is then pumped through the tool, to form a cement plug on top of the bridge plug. Depending on the requirements of the job that is being carried out, and applicable best practices, once the cement has set, it may be pressure tested, and/or weight tested, to ensure that the cement has formed an adequate blockage in the well bore.

In an initial configuration of the drill string, and through these initial stages, the slips 49 of the tool 1 will be in their retracted position.

Once the cement plug has been formed and set, the indexing system of the tool 1 may be operated to set the slips 49 into their deployed position, so that the slips 49 grip against the inner surface of the casing. The casing cutter is then activated, and the drill string is rotated so that blades of the casing cutter cut through the casing, at a level above the cement plug.

Once the casing has been cut, rotation of the drill string will cease, and the blades of the casing cutter may be retracted.

As an optional further step, the slips 49 of the tool 1 may remain engaged with the casing (or be disengaged and then re-engaged), and the drill string may be pulled upwardly so that the section of casing above the cut is lifted out of the well bore.

It should be noted that, when the slips 49 are engaged with a cut section of casing which is being lifted from the well bore, the weight of the section of casing itself will keep the slips 49 in the deployed position, and it is not necessary to maintain fluid flow through the tool 1 in order to keep the slips 49 in this position. This relies on the weight of the casing being greater than the force applied by the spring 58, and operators should ensure that a suitable spring is used, particularly if a short (and therefore light) section of casing is to be gripped and lifted upwardly.

The skilled reader will therefore appreciate how a tool as described above may be used effectively in a drill string to perform a plug and abandonment operation in a single trip into the well bore.

In such a method, the casing cutter is likely to be positioned in the drill string below the tool 1, particularly as this will allow the drill string to be pulled upwardly, to place the casing in tension while the casing cutter cuts the casing. Many designs of casing cutter are activated through a ball being dropped through the drill string and received in a seat, and the skilled person will be aware of many examples of this.

In embodiments of the invention, the tool 1 and casing cutter may be configured so that a ball of the same size can be used to control both the indexing system of the tool and the blades of the casing cutter. This means that, when a ball has been dropped and received in the seat 73 of the tool, used to control the indexing system, and then extruded through the seat 73, the ball may exit the tool 1 through its lower end and be caught in a seat of the casing cutter, to operate the casing cutter. The same ball may therefore be used to control the tool 1 and subsequently activate the blades of the casing cutter.

In the second embodiment described above, and shown in FIG. 14, it will not be desirable for cement flowing through the tool 1 to pass through the communication port 78 and into the under-piston region 74. To prevent this, a plug or other obstruction (not shown) may initially be placed in the communication port 78, to prevent cement from entering the communication port 78 during a cementing phase. The plug may then be removed from the communication port 78.

In one example, the communication port 78 has tapered side walls, so that the communication port 78 is wider where it meets the delivery pipe 40, and narrower where it connects to the under-piston region 74. A frustoconical or otherwise tapered plug may be initially placed in the communication port 78, to obstruct the communication port 78.

Cement and other fluids that are pumped through the tool will not dislodge the plug, and high pressure within the delivery pipe will tend to drive the plug into firmer engagement with the side walls of the communication port 78.

Once cementing is completed, the piston 6 may be driven downwardly, and since the under-piston region 74 is isolated at this stage, this will immediately increase the pressure in the under-piston region 74. The result of this will be to eject the plug from the communication port 78. The communication port 78 is then open, and the tool is ready for use with the piston 6 in a balanced state.

Embodiments of the invention provide a tool having an indexing system which controls the distance by which a delivery pipe extends into a lower part of the tool, so that fluid flowing into the tool is either diverted through a port into a chamber, or bypasses the port and does not enter the chamber. One application of this is the setting of slips, as discussed above. However, the skilled reader will appreciate that there are other applications of this technique.

Figure 15:
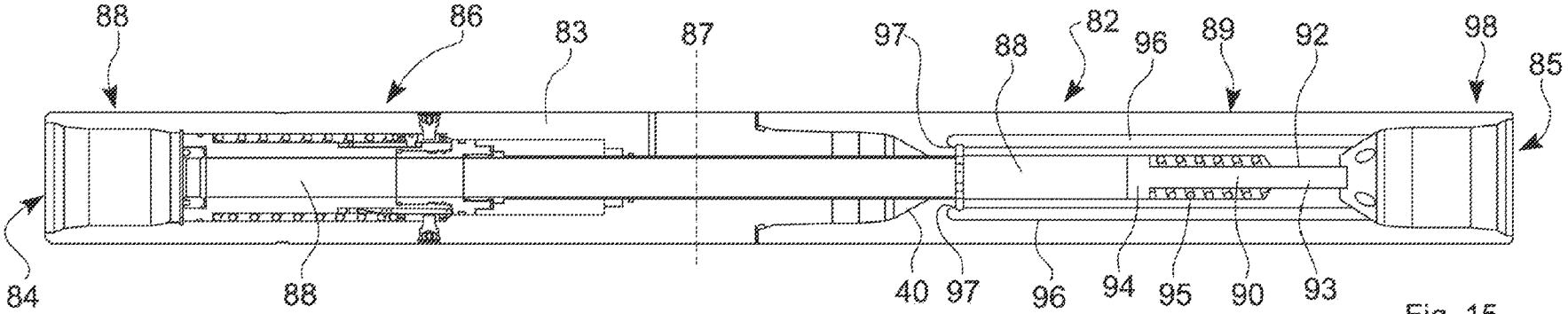
FIGS. 15 to 17 show a further tool embodying the invention, in different stages of operation.
Figure 16:
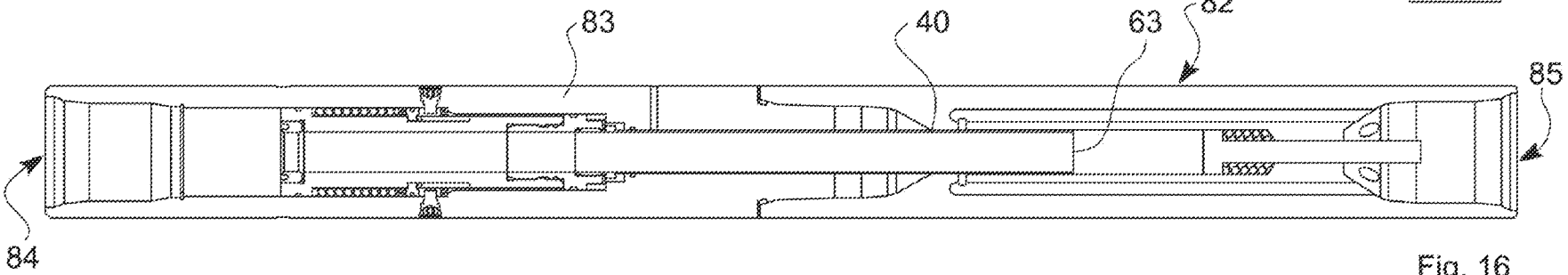
Figure 17:
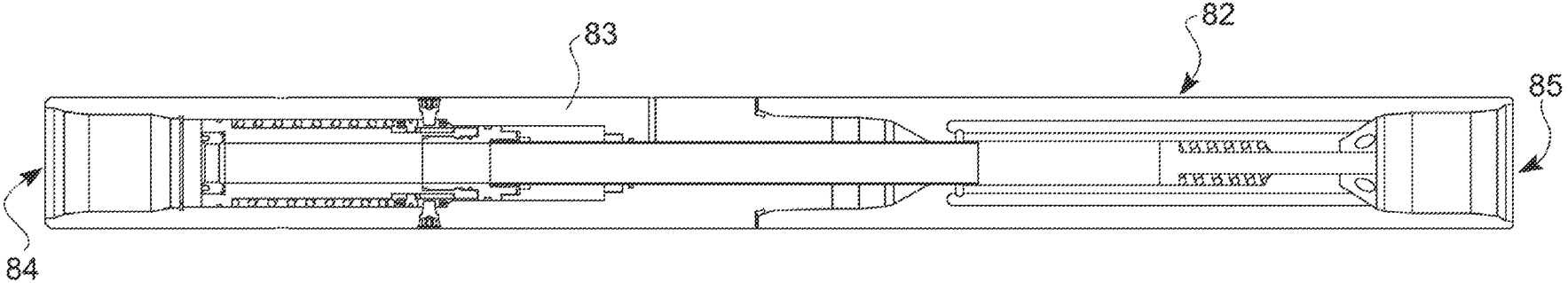

With reference to FIGS. 15 to 17, a further tool 82 embodying the invention is shown. The further tool comprises a tool body 83 having an upper connection 84 and a lower connection 85.

The further tool 82 has an indexing system 86, which may be the same as the indexing systems described above in connection with the other embodiments. A line 87 is shown in FIG. 15, and everything above (i.e. left of) the line 87 is the same as in the tool shown in FIG. 14.

A main flow bore 88 passes along the tool 82, from the upper end 91 thereof. However, unlike the embodiments discussed above, the main flow bore 88 terminates in a closed end 89, at a position below the end 63 of the delivery pipe 40. At the closed end 89, the flow bore 88 narrows, and transitions into a relatively narrow passage 92. A balancing piston 90 is received in the passage 92. The balancing piston 90 has a stem 93, which in the depicted embodiment is straight and of circular cross-section. The stem 93 fits closely within the passage 92.

The balancing piston 90 has a head 94, which is on the upper end of the stem 93, and which has a width which is substantially the same as, or slightly less than, the internal width of the flow bore 88. The head 94 preferably has a seal provided around the periphery thereof, to seal against the inner surface of the flow bore 88.

A spring 95 is provided around the upper part of the stem 93. The upper end of the spring 95 contacts the rear side of the head 94, and the lower end of the spring 95 contacts the bottom end of the flow bore 88, around the entrance to the passage 92. The spring 95 biases the balancing piston 90 upwardly, towards the upper end 91 of the tool 82.

A number of bypass passages 96 are provided beside a lower part of the flow bore 88. In the embodiment shown, eight bypass passages 96 are provided, although only two of these can be seen in the figures. Preferably, the combined total flow area of the bypass passages 96 is comparable to the flow area of the main flow bore 88 (e.g. the combined flow area of the bypass passages may be more than 50%, or more than 75%, of the flow area of the main flow bore). However, any number of suitable bypass passages (including having only a single bypass passage) may be used. The bypass passages 96 are preferably parallel or substantially parallel with the flow bore 88.

A communication port 97 extends from the flow bore 88 to each of the bypass passages 96. The communication ports 97 are all preferably at the same level within the tool 82 (i.e. all at the same longitudinal position along the flow bore 88).

Each bypass passage 96 communicates with the lower end 98 of the tool 82, such that fluid within one of the bypass passages 96 can flow out of the lower end of the tool 82.

FIG. 15 shows the situation in which the control pin 32 of the indexing system 86 is received in a relatively short trough 18*a* of the track 13. The end 63 of the delivery pipe 40 lies above the entrances to communication ports 97.

Fluid in the flow bore 88 may therefore flow through the communication ports 97, into the bypass passages 96, and out of the lower end 98 of the tool 82. Flow through the tool 82 is therefore possible.

If the indexing system 86 is cycled, the delivery pipe 40 will be driven downwardly, into the position shown in FIG. 16, and when the control pin 32 is received in a relatively long trough 18*b*, the delivery pipe 40 will come to rest in the position shown in FIG. 17, in which the end 63 of the delivery pipe 40 lies below the entrances to the communication ports 97. Fluid in the flow bore 88 therefore cannot escape through the lower end 98 of the tool 82, and the tool 82 effectively presents a dead end to fluid.

The skilled reader will therefore appreciate that the tool 82 can either allow or prevent fluid flow, depending on the position of the indexing system 86.

The balancing piston 90 is provided to allow movement of the indexing system 86 when a ball is received in the seat 73 of the piston 6. Once a ball is received in the seat 73, the volume of fluid below the ball is isolated, and will be effectively incompressible, which would prevent downward motion of the piston 6.

If one or more balls are extruded through the seat 73, they will collect at the lower end of the flow bore 88, i.e. above the balancing piston 90. The length of flow bore 88 between the communication ports and the closed end 89 of the flow bore 88 should therefore be long enough to accommodate an appropriate number of balls to allow the intended operation of the tool 82.

A tool 82 such as that shown in FIGS. 15 to 17 may be used to activate/deactivate other tools in the drill string that are dependent on flow and/or fluid pressure. For instance, if the drill string includes a jacking assembly, flow in the drill string can be blocked to allow sufficient pressure to be created for operation of the jacking assembly.

Figure 18:
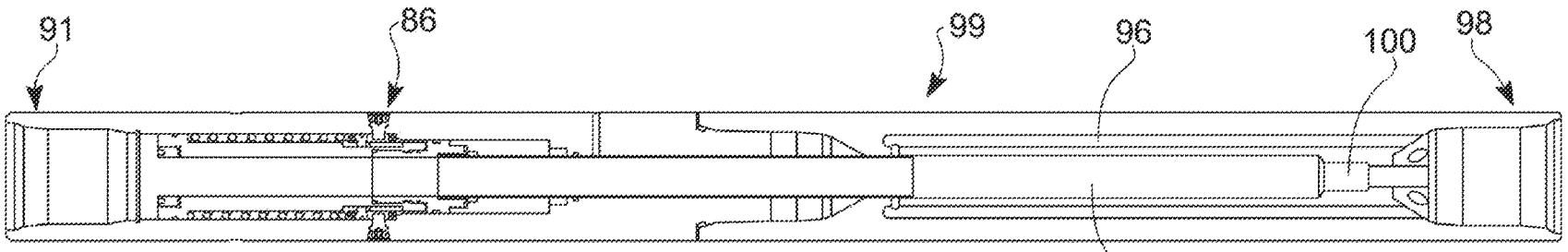
FIGS. 18 to 20 show yet a further tool embodying the invention, in different stages of operation.
Figure 19:
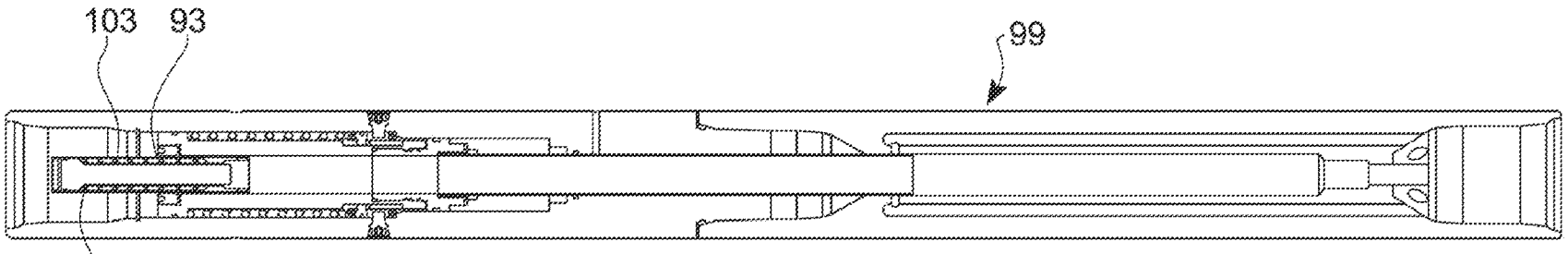
Figure 20:
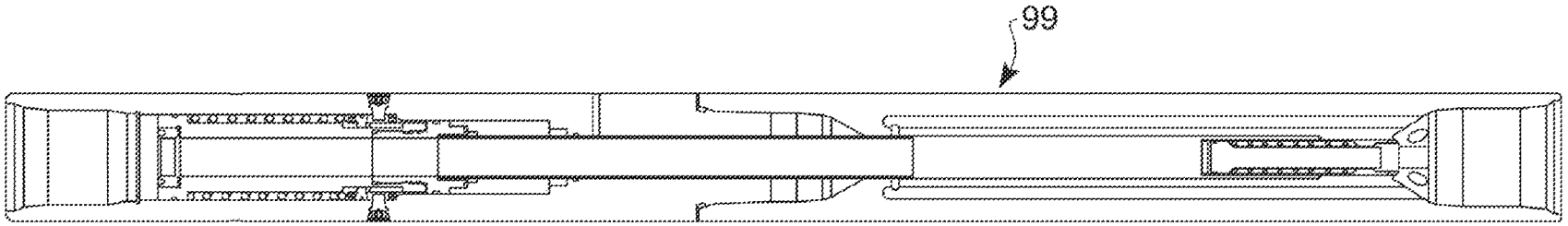

FIGS. 18 to 20 show a further embodiment of a tool 99 embodying the invention.

In this embodiment, the tool 99 has an indexing system 86, and also bypass passages 96 and communication ports 97, as shown in the embodiment of FIGS. 15 to 17. However, in an initial state which is shown in FIG. 18, no compensating piston 90 is present. Instead, the flow bore 88 has a narrowed section 100 near the bottom end thereof.

In this initial state, fluid may flow freely along the flow bore 88 from the upper end 91 of the tool 99 to the lower end 98 thereof.

When required, the tool 99 can be converted into an isolation tool. A dart 101 is dropped through the drill string, and enters the upper end 91 of the tool 99. The dart 101 is a unit comprising a balancing piston 102, similar to the balancing piston 90 of the previous embodiment, with a spring 95 positioned around the stem 93 of the balancing piston 102. FIG. 19 shows the position when the dart 101 has entered the upper end 91 of the tool 99.

The dart 101 passed along the flow bore 88 of the tool 99, and is received in the narrowed section 100 of the flow bore 88, as shown in FIG. 20. The narrowed section 101 presents an upward-facing shoulder on which the dart 101 is received. The dart 101 entirely or substantially blocks the narrowed section 100 of the flow bore 88. In this position, the dart 101 operates in effectively the same way as the balancing piston 90 of the previous embodiment, and the tool 99 can be cycled between allowing flow, and blocking flow, by using the indexing system as discussed above in connection with the previous embodiment.

In use of the further tool 99, the tool 99 can be included in a drill string in the initial position shown in FIG. 18 (i.e. with the communication ports 97 initially covered by the delivery pipe 40). A cementing operation can be carried out, with cement flowing through the tool 99 (which, as the skilled reader will appreciate, would not be readily possible with the tool 82 shown in FIGS. 15 to 17). As cement flows through the tool 99 it will not enter the communication ports 97 or bypass passages 96. Balls can also be pass through the tool 99, and so balls can be dropped into the drill string to operate components within the drill string above or below the tool 99.

When desired, the dart 101 can be dropped through the drill string and received in the tool 99, to convert the tool 99 into the configuration shown in FIG. 20. The tool 99 can then be used to block flow through the drill string selectively, as discussed above.

In one example of use of the tool 99, a drill string is assembled having a bridge plug at its lower end. Above the bridge plug are (in order) a pipe cutter, the tool 99 (without the dart, i.e. in the configuration shown in FIG. 18), a conventional TSA, and a jacking assembly with an upper anchor.

The drill string is run into the wellbore. The bridge plug is activated as described above, and is then separated from the other components of the drill string. Cement is then pumped through the drill string, to form a cement plug on top of the bridge plug. The cement plug may be pressure and/or weight tested, once it has been formed and set.

A ball is then dropped into the drill string to activate the TSA and pipe cutter, and the casing may be cut if required, by rotating the drill string from surface.

The dart is then dropped into the drill string, to convert the tool 99 into the configuration shown in FIG. 20.

A ball is dropped to be received in the seat 73 of the piston 6 of the tool 99, and the indexing system 86 is operated to prevent fluid flow through the bypass passages 96, i.e. so the tool 99 blocks flow therethrough.

Pressure in the drill string is then increased, to pressure up the TSA, jack assembly and upper anchor. The cut section of casing can then be pulled upwardly under jack power, and subsequently lifted upwardly through the wellbore, and latterly if the cut section of casing is stuck at any stage, the jacking assembly can be used to free or dislodge the casing, to allow further lifting of the casing.

Other applications of the invention will be evident to the skilled person.

It should be noted that embodiments of the invention allow fluid to be selectively delivered from a main bore of the tool into a further chamber. This further chamber may contact components which rotate with respect to the bore, in other words with respect to a component through which the bore is formed (for instance, the mandrel 61). This means that the tool can effectively operate slips to grip against the casing of a well bore, while the tool as a whole rotates with respect to the slips. This is in contrast to what is shown in, for example, U.S. Pat. No. 10,190,376. This document discloses examples in which an indexing system selectively drives a sleeve downwardly by a variable distance. When the sleeve is driven downwardly in a certain stage of operation, a lower end of the sleeve directly drives cutters outwardly with respect to the tool body. However, all components of the tool, including the housing, the indexing system and the cutters, are rotationally linked. It will be clear to the skilled reader that a system of this kind would be unsuitable for activating slips, to be used as part of a TSA.

Embodiments of the invention may also allow fluid to be selectively diverted from a main bore to one or more bypass passages, thereby allowing the rate of flow through the tool (or whether flow through the tool is possible at all) to be controlled. Tools which contain indexing mechanisms which can be used to control flow/circulation through the tool have been disclosed in the prior art, for instance in WO2014/055192, U.S. Pat. No. 9,435,168, EP1554460, EP1592863, U.S. Pat. No. 6,899,179, US20100193196, EP 0904479 and U.S. Pat. No. 8,863,852. However, this is achieved in a different manner in these tools, and these tools largely rely on diverting flow through the tool to the annulus.

The skilled reader will appreciate that embodiments of the invention provide a variety of robust tools which will find utility in many different applications.

In this document terms such as "top", "bottom", "upper" and "lower" are used, and these should be interpreted as referring to the tool in an orientation where the upper end of the upper housing (i.e. the left-hand end, in the orientation shown in FIG. 1) is uppermost. However, this is purely for convenience and does not exclude use of the tool in any other orientation, which may be generally horizontal or even with the upper end of the upper housing (as defined above) being lower than the other end of the tool.

When used in this specification and the claims, the term "comprises" and "comprising" and variations thereof mean that specified features, steps or integers and included. The terms are not to be interpreted to exclude the presence of other features, steps or compounds.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realising the invention in diverse forms thereof.

PREFERRED FEATURES OF THE INVENTION

1. A tool comprising:
   - a tool body having an elongate bore passing along at least a part of the length of the body;
   - a secondary chamber within the tool body and positioned adjacent the bore;
   - a flow port extending between the bore and the secondary chamber;
   - a cover component positioned within the bore and moveable between at least two positons along the length of the bore; and
   - a control arrangement connected to the cover component to control movement of the cover component within the bore, the control arrangement comprising a piston which is moveable with respect to the tool body, and a guide component which is positioned adjacent the piston, one of the piston and the guide component having a track formed therein, and the other of the piston and the guide component having a protruding element which is received in the track, wherein:
   - in a first position of the cover component, the cover component covers an entrance to the flow port, so that fluid flowing along the bore may not flow into the flow port; and
   - in a second position of the cover component, the cover component does not cover the entrance to the flow port, so that fluid flowing along the bore may flow through the flow port and into the secondary chamber.
2. A tool according to clause 1, wherein the guide component is arranged at least partly around the exterior of the piston.
3. A tool according to clause 2, wherein the cover component comprises a tube having an end, and wherein in the first position the end of the tube lies below the entrance to the flow port, and wherein the second position the end of the tube lies above the entrance to the flow port.
4. A tool according to clause 2 or 3, wherein the track is formed such that longitudinal movement of the piston with respect to the tool body causes the protruding element to interact with the track, leading to rotation of either the piston or the control component with respect to each other.
5. A tool according to clause 4, wherein the track includes at least one section which is set at an angle to the longitudinal axis of the piston.
6. A tool according to any one of clauses 2 to 5, wherein the piston is connected to the cover component.
7. A tool according to clause 4, wherein the piston is biased in a first direction with respect to the guide component, and wherein the track comprises two or more terminal regions in which the protruding component is received when the piston moves in the first direction, and wherein one of the terminal regions allows the piston to move by a greater distance in the first direction than the other of the terminal regions.

8. A tool according to clause 7, wherein the arrangement of the piston and guide component are such that movement of the piston by a predetermined distance in a second direction, which is substantially opposite to the first direction, followed by movement of the piston in the first direction, moves the guide component from the one of the terminal regions to the other of the terminal regions.

9. A tool according to clause 7 or 8, wherein the track comprises a plurality of sections, each having a terminal region, and wherein the arrangement of the piston and guide component are such that movement of the piston by a predetermined distance in a second direction, which is substantially opposite to the first direction, followed by movement of the piston in the first direction, moves the guide component from one of the terminal regions to a section to the terminal region of the next section.

10. A tool according to any preceding clause, wherein the secondary chamber does not comprise a port extending laterally to communicate with a circumferential outer surface of the tool body.

11. A tool according to any preceding clause, wherein at least a part of the secondary chamber is defined by radially inner and outer surfaces defined within the tool body.

12. A tool according to any preceding clause, wherein at least a part of the secondary chamber is substantially parallel with the bore.

13. A tool according to any preceding clause, wherein the secondary chamber is a drive chamber, having at least one side defined by a movable component, wherein introduction of fluid into the drive chamber causes movement of the movable component.

14. A tool according to clause 13, wherein the tool comprises one or more slips which are movable between a retracted position and a deployed position, and wherein movement of the movable component moves the one or more slips from the retracted position into the deployed position.

15. A tool according to clause 13 or 14, wherein the bore is at least partly defined by a mandrel, and wherein the movable component is rotatable with respect to the mandrel.

16. A tool according to any one of clauses 13 to 15 further comprising a vent port extending between the bore and an exterior of the tool, wherein, when fluid is in the drive chamber and the cover component is in the first position, the fluid may pass from the drive chamber to the exterior of the tool by passing through the vent port.

17. A tool according to any one of clauses 1 to 12, wherein:

the tool has a fluid exit at or near its lower end, through which fluid may flow from the tool into a further component in a drill string; and the secondary chamber is in communication with the fluid exit of the tool.

18. A tool according to clause 17, comprising a plurality of secondary chambers.

19. A tool according to clause 17 or 18, wherein the bore terminates partway along the length of the tool body, such that the bore does not extend to the fluid exit.

20. A tool according to clause 19, wherein the or each secondary chamber bypasses the termination of the bore.

21. A tool according to any one of clauses 17 to 20, further comprising a compensating piston, which protrudes into the bore, and may move with respect to the bore, to allow variation of the volume of the bore.

22. A tool according to clause 21, wherein the compensating piston includes a piston head which fits closely against an interior surface of the bore, and which may move within the bore in response to pressure changes within the bore.

23. A tool according to any one of clauses 19 to 22, wherein the compensating piston comprises or forms part of a blockage that terminates the bore.

24. A tool according to any one of clauses 21 to 23, wherein the bore includes a receiving region, and wherein the compensating piston is provided as part of a unit which may be received in the receiving region so as to present a blockage which terminates the bore.

25. A tool according to any one of the preceding clauses, when dependent upon clause 2, wherein:

the piston moves within a piston chamber, and an under-piston region of the chamber is defined below the piston; and a communication port is defined between the bore and the under-piston region.

26. A tool according to clause 25, wherein the piston has an upper surface, on which fluid may act to drive the piston downwardly with respect to the tool body, and wherein a lower surface, accessible through the under-piston region, on which fluid may act to drive the piston upwardly with respect to the tool body, has an area which is equal or substantially equal to the area of the upper surface.

27. A tool according to any preceding clause, wherein the piston further comprises a seat to receive a ball, and wherein when a ball of a suitable diameter is received in the seat fluid flow through the bore is substantially blocked.

28. A drill string for running into a wellbore, comprising a tool according to any preceding clause.

29. A drill string according to clause 28, further comprising a casing cutter.

30. A drill string according to clause 28 or 29, further comprising a bridge plug.

31. A drill string according to any one of clauses 28 to 30, further comprising a jack apparatus.

32. A method of conducting a procedure within a wellbore, comprising the steps of:

providing a drill string including a tool according to any one of clauses 1 to 27, with the cover component of the tool in either the first or the second position; and operating the control arrangement to move the cover component to the other of the first and second positions.

33. A method according to clause 32, wherein the procedure is plugging the wellbore, and the cover component of the tool is initially in the first position, the method comprising the steps of:

pumping cement through the drill string, including the tool, into the wellbore to form a cement plug in the wellbore; and after the step of pumping cement, operating the control arrangement to move the cover component into the second position.

34. A method according to clause 33, wherein the drill string further comprises a bridge plug, and the method further comprises setting the bridge plug in the wellbore before the cementing step.

35. A method according to clause 33 or 34, wherein the drill string further comprises a casing cutter, and the method further comprises activating the casing cutter to cut a casing of the wellbore after the cementing step.

36. A method according to clause 35, further comprising the steps of gripping the casing at a position above the location where the casing is cut, and lifting an upper section of casing out of the wellbore.

37. A method according to clause 32, wherein the tool is according to any one of clauses 17 to 24, wherein operating the control arrangement comprises moving the cover component between the first position, in which no or substantially no fluid flow through the tool is possible, and the second position, in which fluid may flow through the tool.

38. A method according to clause 37, wherein the tool is according to clause 24, wherein the drill string initially comprises the tool without the unit, and wherein after the drill string is run into the wellbore, the unit is introduced into the drill string, so that it is received in the receiving region of the tool.

39. A method according to clause 38, further comprising the step of pumping cement through the tool, before the unit is introduced into the wellbore.

40. A method according to any one of clauses 32 to 39, wherein all of the steps are carried out in a single trip into the wellbore.

The invention claimed is:

1. A tool comprising:

a tool body having an elongate bore passing along at least a part of the length of the body;

a secondary chamber within the tool body and positioned adjacent the bore, wherein the secondary chamber is a drive chamber, having at least one side defined by a movable component, wherein introduction of fluid into the drive chamber causes movement of the movable component;

a flow port extending between the bore and the secondary chamber;

a cover component positioned within the bore and moveable between at least two positions along the length of the bore; and a control arrangement connected to the cover component to control movement of the cover component within the bore, the control arrangement comprising a piston which is moveable with respect to the tool body, and a guide component which is positioned adjacent the piston, one of the piston and the guide component having a track formed therein, and the other of the piston and the guide component having a protruding element which is received in the track, wherein:

in a first position of the cover component, the cover component covers an entrance to the flow port, so that fluid flowing along the bore may not flow into the flow port; and in a second position of the cover component, the cover component does not cover the entrance to the flow port, so that fluid flowing along the bore may flow through the flow port and into the secondary chamber.

2. A tool according to claim 1, wherein the guide component is arranged at least partly around the exterior of the piston.

3. A tool according to claim 2, wherein the track is formed such that longitudinal movement of the piston with respect to the tool body causes the protruding element to interact with the track, leading to rotation of either the piston or the guide component with respect to each other.

4. A tool according to claim 3, wherein the piston is biased in a first direction with respect to the guide component, and wherein the track comprises two or more terminal regions in which the protruding component is received when the piston moves in the first direction, and wherein one of the terminal regions allows the piston to move by a greater distance in the first direction than the other of the terminal regions.

5. A tool according to claim 1, wherein the tool does not comprise a port extending laterally from the secondary chamber to communicate with a circumferential outer surface of the tool body.

6. A tool according to claim 1, wherein the tool comprises one or more slips which are movable between a retracted position and a deployed position, and wherein movement of the movable component moves the one or more slips from the retracted position into the deployed position.

7. A tool according to claim 1, wherein:

the tool has a fluid exit at or near a lower end of the tool, through which fluid may flow from the tool into a further component in a drill string; and the secondary chamber is in communication with the fluid exit of the tool.

8. A tool according to claim 7, wherein the bore terminates partway along the length of the tool body, such that the bore does not extend to the fluid exit.

9. A tool according to claim 7, further comprising a compensating piston, which protrudes into the bore, and may move with respect to the bore, to allow variation of the volume of the bore.

10. A tool according to claim 1, wherein:

the guide component is arranged at least partly around the exterior of the piston;

the piston moves within a piston chamber, and an under-piston region of the chamber is defined below the piston; and a communication port is defined between the bore and the under-piston region.

11. A tool according to claim 10, wherein the piston has an upper surface, on which fluid may act to drive the piston downwardly with respect to the tool body, and wherein a lower surface, accessible through the under-piston region, on which fluid may act to drive the piston upwardly with respect to the tool body, has an area which is equal or substantially equal to the area of the upper surface.

12. A tool according to claim 1, wherein the piston further comprises a seat to receive a ball of a suitable diameter, and wherein when the ball is received in the seat fluid flow through the bore is substantially blocked.

13. A drill string for running into a wellbore, comprising a tool according to claim 1.

14. A drill string according to claim 13, further comprising one or more of a casing cutter, a bridge plug, and a jack apparatus.

15. A method of conducting a procedure within a wellbore, comprising:

providing a drill string including a tool according to claim 1, with the cover component of the tool in either the first or the second position; and operating the control arrangement to move the cover component to the other of the first and second positions.

16. A method according to claim 15, wherein the procedure is plugging the wellbore, and the cover component of the tool is initially in the first position, the method comprising:

pumping cement through the drill string, including the tool, into the wellbore to form a cement plug in the wellbore; and after the step of pumping cement, operating the control arrangement to move the cover component into the second position.

17. A method according to claim 16, wherein:

the drill string further comprises a bridge plug, and the method further comprises setting the bridge plug in the wellbore before the cementing step; and the drill string further comprises a casing cutter, and the method further comprises activating the casing cutter to cut a casing of the wellbore after the cementing step.

18. A method according to claim 15, wherein:

the tool has a fluid exit at or near a lower end of the tool, through which fluid may flow from the tool into a further component in a drill string;

the secondary chamber is in communication with the fluid exit of the tool; and operating the control arrangement comprises moving the cover component between the first position, in which no or substantially no fluid flow through the tool is possible, and the second position, in which fluid may flow through the tool.

19. A method according to claim 18, wherein:

the bore includes a receiving region;

a compensating piston is provided as part of a unit which may be received in the receiving region so as to present a blockage which terminates the bore;

the drill string initially comprises the tool without the unit; and after the drill string is run into the wellbore, the unit is introduced into the drill string, so that it is received in the receiving region of the tool.

20. A method according to claim 15, wherein all of the steps are carried out in a single trip into the wellbore.

* * * * *